US006517294B2

(12) United States Patent
Vreeland

(10) Patent No.: US 6,517,294 B2
(45) Date of Patent: Feb. 11, 2003

(54) APPARATUS FOR INSTALLING A SILT FENCE

(76) Inventor: Gregory M. Vreeland, 1217 Lyons Rd., Centerville, OH (US) 45458

( * ) Notice: Subject to any disclaimer, the term of this patent is extended or adjusted under 35 U.S.C. 154(b) by 0 days.

(21) Appl. No.: 09/997,572

(22) Filed: Nov. 29, 2001

(65) Prior Publication Data

US 2002/0192029 A1 Dec. 19, 2002

Related U.S. Application Data

(63) Continuation-in-part of application No. 09/884,386, filed on Jun. 19, 2001, now Pat. No. 6,398,459.

(51) Int. Cl.[7] ..... E02D 7/02; E01F 7/02

(52) U.S. Cl. ..... 405/302.7; 405/232; 173/90; 173/184; 256/12.5

(58) Field of Search ..... 173/114, 90, 184; 227/147; 254/29 R; 405/259.1, 231, 232, 302.7, 302.6, 302.4, 116, 115, 114; 256/12.5

(56) References Cited

U.S. PATENT DOCUMENTS 2,634,092 A * 4/1953 Lindquist ..... 254/29 R
3,182,459 A * 5/1965 Grether et al. ..... 405/115
3,722,861 A * 3/1973 Anderson ..... 173/184
4,261,400 A * 4/1981 Spence ..... 173/29
4,705,427 A 11/1987 Atkins et al.
4,915,180 A 4/1990 Schisler
5,039,250 A * 8/1991 Janz ..... 256/12.5
5,282,511 A * 2/1994 Burenga et al. ..... 173/184
5,772,362 A * 6/1998 Sims ..... 173/184
5,819,857 A * 10/1998 Rohrer ..... 173/90
5,915,878 A * 6/1999 Carpenter ..... 405/270
6,053,665 A 4/2000 Richardson
6,158,923 A 12/2000 Wheeler et al.

* cited by examiner

*Primary Examiner*—Frederick L. Lagman
(74) *Attorney, Agent, or Firm*—Jacox, Meckstroth & Jenkins

(57) ABSTRACT

A tractor carries a vertically adjustable frame supporting a horizontal shaft for a supply roll of silt fence fabric. A flat vertical plow blade is mounted on the frame and has a front surface and a rear surface. A thinner flat vertical fin is supported directly behind the plow blade by a horizontal fabric guide bar attached to the frame. The fin has a downwardly and rearwardly curved front surface for receiving an intermediate portion of the fabric directed around the guide bar and for folding an edge portion of the fabric into the slot formed by the plow blade. After the ground is compacted by a tractor wheel, wood stakes are driven into the ground by a hydraulically actuated cylinder device mounted on a side of the tractor frame between the front and rear wheels, and the fabric is attached to the stakes.

17 Claims, 5 Drawing Sheets

25
31
80
84
90
82
33
86
28
36
34
53
68
92
14
80
82
66
41
38
70
51
54
53
78
56
50
58
31
12
26
39
41

33
28
92
31
51
41
39
14
72
70
68
58
73
75
50
62
76
12

APPARATUS FOR INSTALLING A SILT FENCE

RELATED APPLICATION

This application is a continuation-in-part of application Ser. No. 09/884,386, filed Jun. 19, 2001, now U.S. Pat. No. 6,398,459.

BACKGROUND OF THE INVENTION

The present invention relates to a machine or apparatus for installing a longitudinal edge portion of a fabric silt fence into the ground so that a major portion of the fabric projects above the ground and is supported by longitudinally spaced vertical stakes. Various forms of such machines or apparatus are disclosed in U.S. Pat. Nos. 4,705,427, 5,915,878, 6,053,665 and 6,158,923. The '427 patent discloses apparatus having a plow shoe to form an open furrow into which an edge portion of a perforated film is rolled into the furrow by a wheel, after which the ground is plowed back into the furrow with a disc. In the '878 patent, a rotary disc cuts a slot into the ground, and a rotary wheel feeds a rope from a supply roll into the bottom of the slot along with an edge portion of a fabric silt fence wrapped around the rope. The frame supports a roll of silt fence along with a spool of rope. The '665 patent discloses apparatus for installing a silt fence fabric having an enlarged edge portion which is fed through a slotted channel within the back of a blade having a vertical ground cutting edge. The '923 patent discloses a machine for forming a trench within the ground, inserting a silt fence fabric while driving preattached stakes into the ground and then backfilling the trench.

SUMMARY OF THE INVENTION

The present invention is directed to an improved and simplified machine or apparatus which is adapted to mount on a tractor for forming a narrow slot within the ground and folding a lower edge portion of a silt fence fabric directly into the narrow slot without requiring a silt fence fabric having an enlarged lower edge portion or the use of a continuous rope to enlarge the lower edge portion of the fabric. The apparatus of the invention also uses commercially available silt fence material or fabric and provides for conveniently and quickly compacting the soil adjacent the narrow slot which receives the folded edge portion of the silt fence. In addition, the invention includes a stake driving apparatus which may also be mounted on the tractor for quickly and conveniently driving or pressing silt fence stakes into the ground adjacent the lower edge portion of the fence.

In accordance with one embodiment of the invention, the apparatus includes a fabricated steel frame having a three point hitch for mounting the frame on the hydraulically controlled and rear projecting lift arms of a conventional tractor. The frame supports a flat vertical plow blade having a downwardly and forwardly curved front surface and a downwardly and rearwardly curved rear surface. The frame also includes a pair of parallel spaced horizontal arms or rails which support an adjustable shaft extending through the tubular core of a supply roll of the silt fence fabric.

A horizontal fabric guide rod or bar is positioned above the rear surface of the plow blade and supports a flat vertical fin behind the plow blade and having a downwardly and rearwardly curved front surface which cooperates with the rear surface of the plow blade to define a curved slot for receiving an intermediate portion of the fabric web directed from the supply roll around the fabric guide rod or bar. As the plow blade is pulled through the soil or ground, it forms a narrow vertical slot, and the fin cooperates with the ground for progressively folding and inserting an edge portion of the fabric web and with the upper portion of the fabric web overlying the ground surface. The front and rear wheels of the tractor are then driven over the ground where the folded edge portion of the fabric web is inserted to compact the ground firmly around the folded edge portion and thereby lock the edge portion into the ground. A series of horizontally spaced wood stakes are then driven or pressed into the ground adjacent the inserted folded edge portion of the fabric by a hydraulically actuated cylinder device mounted on the tractor between the front and rear wheels and inboard of the wheels. The upper portion of the fence is then attached to the wood stakes. The stakes may also be steel rebar stakes with a cap member mounted on the upper end portion of each rebar stake for attaching the upper portion of the fabric to the stakes to form the silt fence.

Other features and advantages of the invention will be apparent from the following description, the accompanying drawings and the appended claims.

DESCRIPTION OF THE PREFERRED EMBODIMENTS

Figure 1:
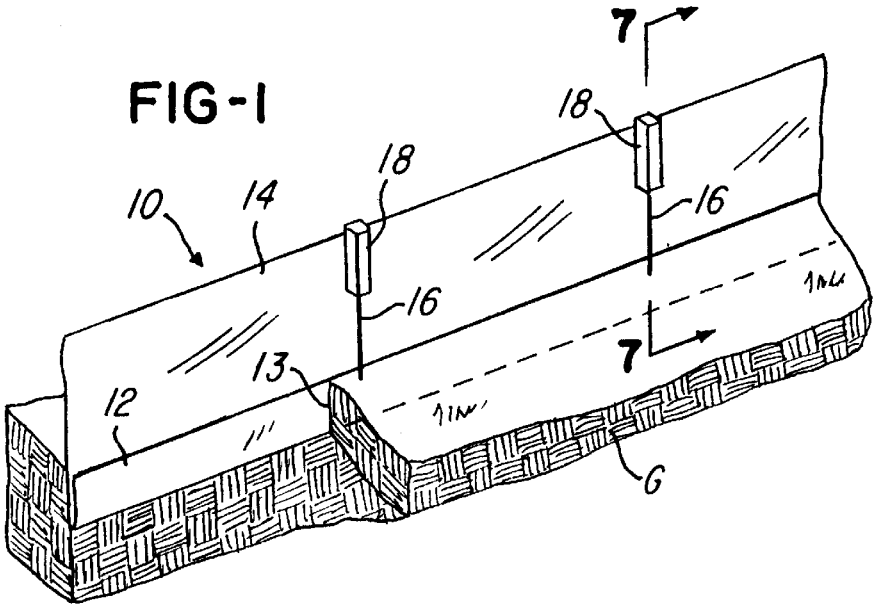
FIG. 1 is a fragmentary perspective view of a silt fence installed within the ground and supported in accordance with the invention.
Figure 7:
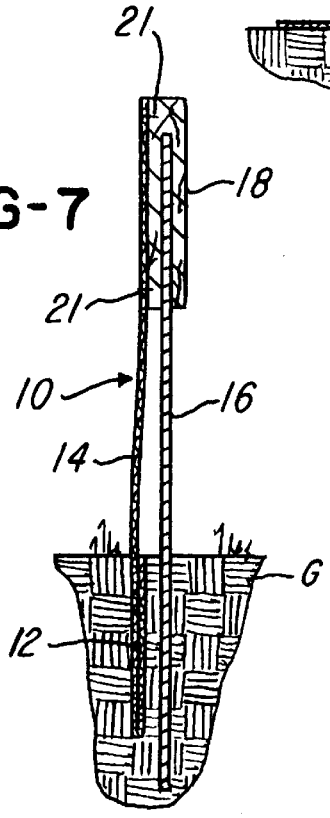
FIG. 7 is a vertical section of the silt fence and a support stake constructed and installed in accordance with the invention, taken generally on the line 7—7 of FIG. 1.

FIG. 1 illustrates a woven fabric silt fence 10 which has a lower folded edge portion 12 buried within a slot 13 formed in the soil or ground G. Preferably the folded edge portion 12 has a width in the range of 6" to 8", and an upper portion 14 of the fabric silt fence 10 projecting above the ground is on the order of 16" high. The upper portion 14 of the silt fence is retained in a generally vertical position by a series of longitudinally spaced support stakes 16 (FIGS. 1 & 7), in the form of sections of steel reinforcing rod or bar, commonly referred to as a "rebar". As shown in FIG. 7, a cap member 18, in the form of a wood 2"×2", has a hole within its lower end for receiving the upper end portion of a rebar stake 16, and the upper portion 14 of the silt fence 10 is attached to each cap member 18 on each stake 16 by a plurality of staples 21. The stakes 16 are driven into the ground at longitudinally spaced intervals, for example, ten feet, along the silt fence 10 after the folded lower edge portion 12 of the silt fence is inserted into the ground and after the ground is compacted. Each cap member 18 is mounted or installed on the corresponding stake 16 after the stake is driven into the ground adjacent the silt fence, as shown in FIG. 7. The stakes may also be conventional wood 2"×2" stakes.

Figure 2:
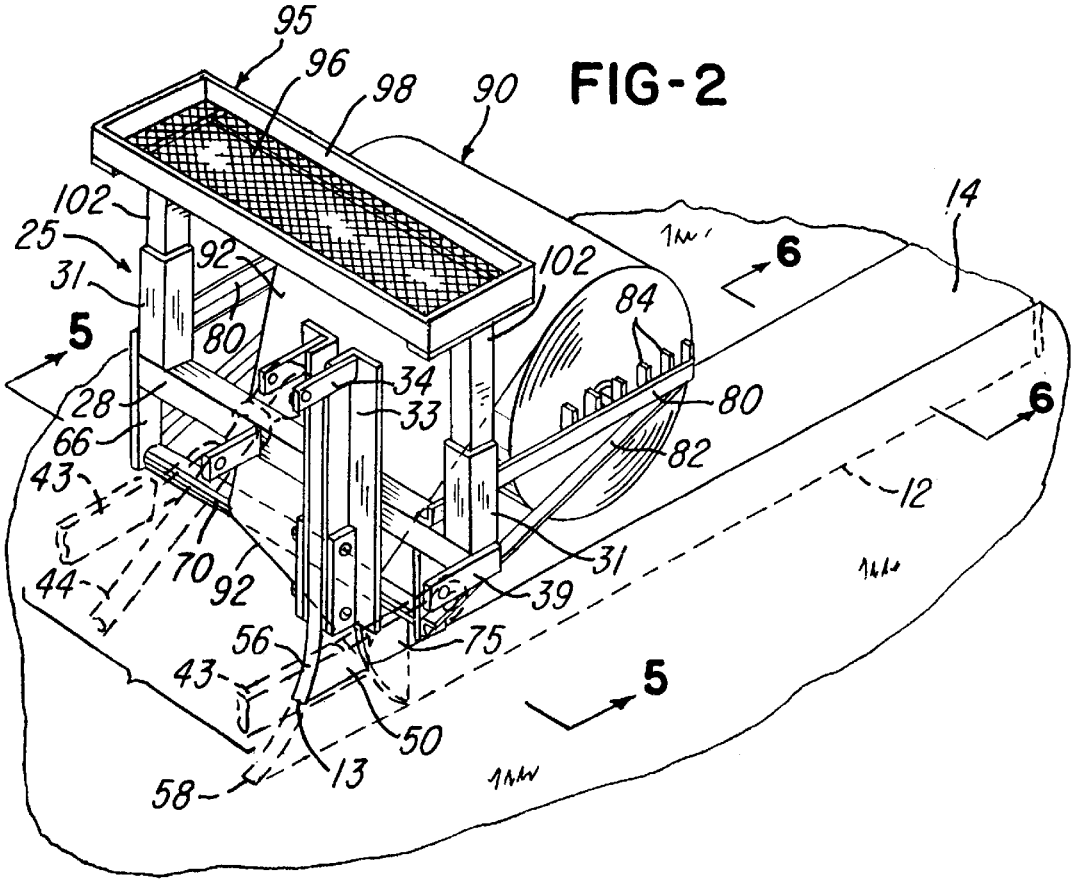
FIG. 2 is a perspective view of apparatus constructed in accordance with the invention for receiving a supply roll of silt fence and for installing the silt fence shown in FIG. 1.

Referring to FIGS. 2–5, the folded lower edge portion 12 of the silt fence 10 is inserted into the soil or ground G by an apparatus or machine 25 which includes a fabricated steel frame 26 having a square cross tube 28 with a pair of square vertical socket tubes 31 welded to opposite end portions of the cross tube 28. A pair of parallel spaced vertical angle members 33 are also welded to the cross tube 28, and a pair of horizontal hitch bars 34 are welded to the upper end portions of the angle members 33 and have horizontally aligned holes 36. A set of forwardly projecting hitch bars 38 and 39 are also welded to the cross tube 28 and have horizontally aligned holes 41. As shown in FIG. 2, the holes 36 and 41 are adapted to receive pivot pins to form a conventional three point hitch for attaching the frame 26 to a pair of draft links 43 connected by lift links to hydraulically controlled lift arms and to a center or top link rod 44, all projecting rearwardly from a conventional small farm tractor (not shown).

A flat vertical plow blade 50 (FIGS. 3 & 4) has a uniform thickness, for example, one inch, and includes an upper portion 51 sandwiched between the angle members 33 and secured by a pair of bolts 53 and a pair of reinforcing bars 54. The plow blade 50 has a downwardly and forwardly curved front surface 56 which cooperates with a flat bottom surface to form a leading cutting edge 58. The plow blade 50 also has a downwardly and rearwardly curved rear surface 62 (FIG. 4) which provides the plow blade with a generally inverted Y configuration. A set of downwardly projecting plates or brackets 66 (FIG. 3) and 68 (FIG. 4) are welded to the cross tube 28 of the frame 26 and support a horizontal guide tube or bar 70 having opposite ends welded to the bracket 66 and 68. A bracket or plate 72 is welded to the guide bar 70 at a location spaced inwardly from the end of the bar, and a pair of bolts 73 connect the bracket 68 to a vertical fin 75 having a downwardly and rearwardly curved front surface 76. The fin 75 is thinner than the plow blade 50, for example, on the order of ¼ inch, and the curved front surface 76 on the fin 75 cooperates with the curved rear surface 62 on the plow blade 50 to define a downwardly and rearwardly extending curved slot 78 having a uniform width of about ¼ inch.

A pair of parallel spaced elongated horizontal arms or rails 80 have forward end portions welded to the cross tube 28 of the frame 26, then each arm is reinforced by an inclined angle brace member 82 having a rearward end portion welded to the corresponding rail 80 and a forward end portion welded to the corresponding bracket 66 and 68. A series of parallel spaced vertical divider plates 84 are welded to each rail 80 to define a series of pockets, and the pockets receive opposite end portions of a substantially horizontal support rod or axle 86. The axle 86 extends through the center cylindrical core of a supply roll 90 of the fabric silt fence 10. A web 92 of the fabric silt fence is coiled into the roll 90 and has a width of about thirty inches, but the apparatus may be constructed to handle a wider or narrower web.

Referring to FIG. 2, a rectangular tray 95 has an expanded metal bottom 96 surrounded by a rectangular metal frame 98, and the tray 95 is supported above the tubular cross member or tube 28 by a pair of vertical square posts 102 which telescope into the square socket tubes 31 to provide for conveniently removing the tray 95. The tray 95 supports and carries a supply of rebar stakes 16 and a supply of cap members 18 so that they are conveniently accessible during installation of the silt fence 10.

In operation of the machine or apparatus 25, when the frame 26 is lowered by the hydraulically controlled draft links 43 on the tractor, the plow blade 50 cuts into the ground to form the narrow slot 13 as the tractor moves forwardly. The silt fence web 92 is directed from the supply roll 90 around the guide tube or bar 70, and an intermediate portion of the web is directed through the slot 78 so that the fin 75 and the ground cause the web to fold and form the folded edge portion 42 within the narrow slot formed by the plow blade 50, as shown in FIG. 2. As the folded edge portion 12 of the silt fence web 92 is inserted or fed into the slot 13 within the ground, the upper portion 14 of the silt fence web 92 overlies the ground, as also shown in FIG. 2. After the folded edge portion 12 of a desired length of the fabric silt fence 10 is installed, the apparatus 25 is elevated by the hydraulically controlled arms 43, the fabric silt fence web 92 is severed behind the apparatus, and the tractor is driven back over the silt fence so that a tractor wheel 110 (FIG. 6) compacts the earth or ground on both sides of the folded edge portion 12 of the silt fence, thereby locking the folded edge portion into the ground. As mentioned above, the rebar stakes 16 are then driven into the ground adjacent the silt fence 10 at longitudinally spaced intervals, the wood cap members 18 are mounted on the stakes, and the upper portion 14 of the silt fence 10 is attached or stapled to the wood cap members 18.

Figure 8:
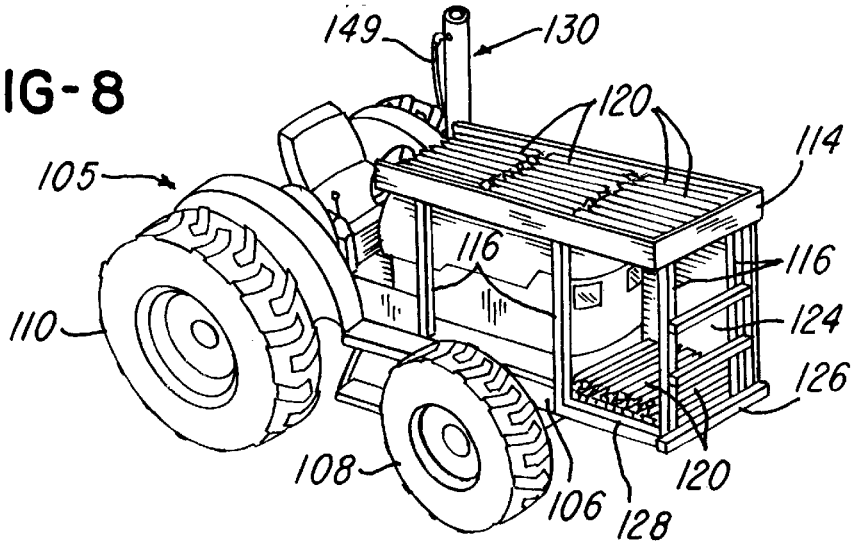
FIG. 8 is a perspective view of a tractor equipped with a stake supply rack and a hydraulically actuated cylinder device for driving or pressing the stakes into the ground adjacent the silt fence after it is compacted as shown in FIG. 6.
Figure 9:
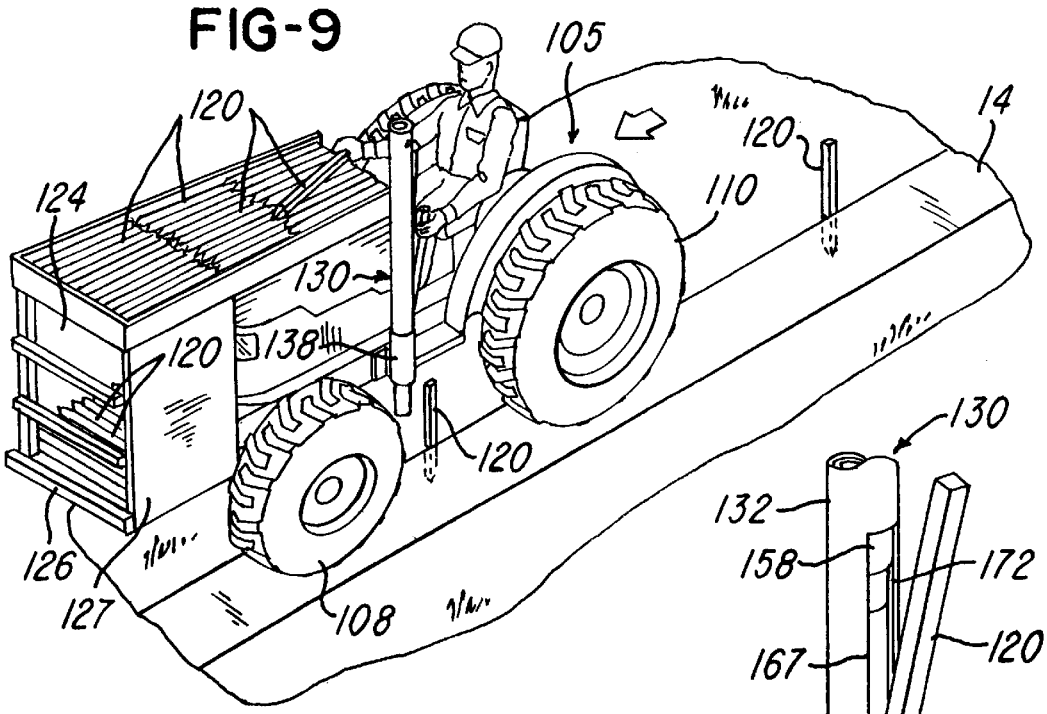
FIG. 9 is another perspective of the tractor and the stake pressing device and showing the installation of the stakes adjacent the silt fence.

Referring to FIGS. 8 & 9, a conventional farm or utility tractor 105 includes a main or base frame 106 which is supported by a pair of front wheels 108 and a pair of larger rear wheels 110. The tractor 105 has the rearwardly projecting lift arms 43 and center stabilizing rod 44 for supporting the apparatus or machine 25 described above in connection with FIGS. 2–5 for installing the lower folded edge portion 12 of the silt fence 10 within the ground G. The apparatus 25 has been omitted from FIGS. 8 & 9 for simplification. As shown in FIGS. 8 & 9, the tractor frame 106 supports a generally horizontal tray or platform 114 above the hood of the tractor by a set of vertical legs 116 secured to the frame 106. The tray or platform 114 supports a supply of wooden stakes 120 such as the conventional wood 2"×2" stakes having a pointed end portion 121 and a length of about 32". An additional supply of stakes 120 is carried by the tractor 105 in a compartment 124 located in front of the tractor under the tray or platform 114. The compartment 124 is defined by the front vertical legs 116, cross frame members 126, a side wall 127 (FIG. 9) and a bottom wall or platform supported by forwardly projecting frame members 128.

Figure 10:
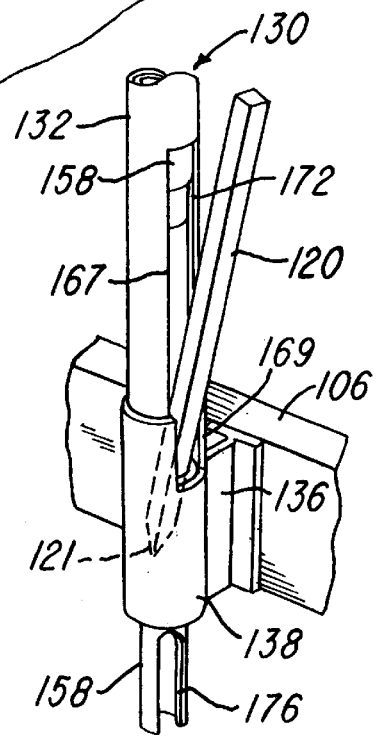
FIG. 10 is a fragmentary perspective view of the stake pressing device shown in FIG. 9 and with a stake being inserted into the device.
Figure 11:
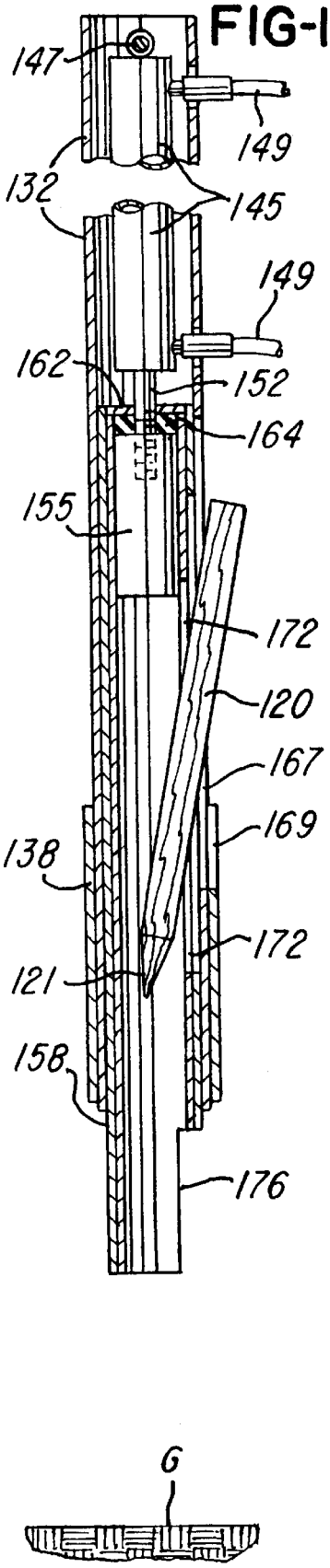
FIGS. 11–14 are fragmentary axial sections of the stake pressing device and illustrating the operation of the device for pressing or driving a stake into the ground.
Figure 12:
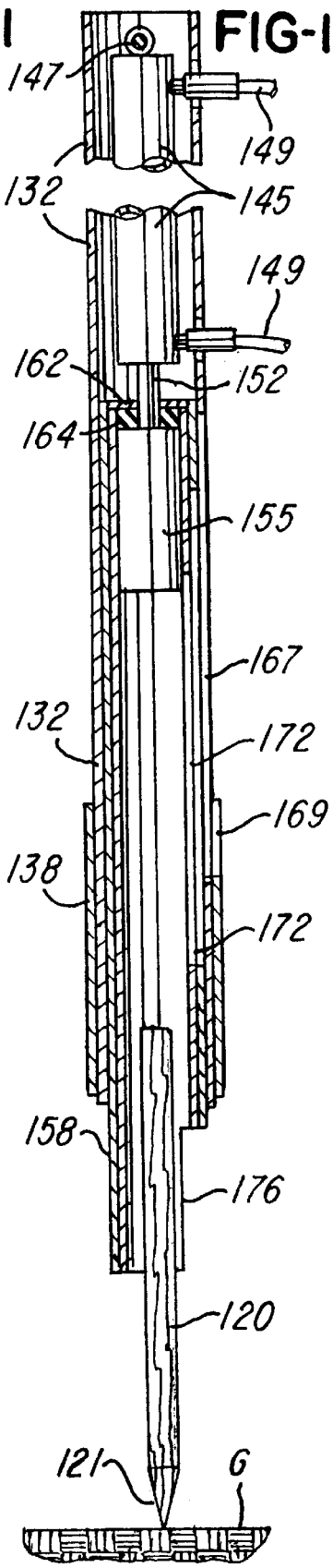
Figure 13:
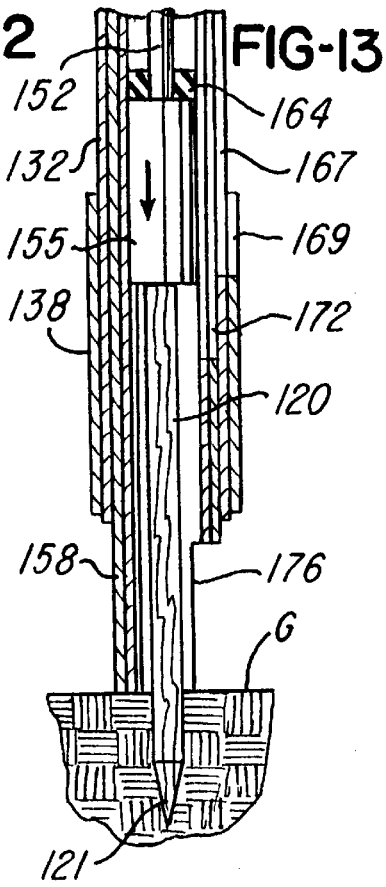

The tractor 105 also carries a stake driving device or apparatus 130 which includes an outer vertical support member or tube 132 which is rigidly connected to the tractor 106 by a support bracket 136 (FIG. 10) bolted to the frame 106 and welded to a base tube 138 which receives and is welded to the lower end portion of the vertical support tube 132. As shown in FIGS. 11–14, the vertical support tube 132 encloses an elongated double acting hydraulic cylinder 145 having an upper end supported by a cross pin 147 and connected by flexible hydraulic lines or conduits 149 to the conventional hydraulic fluid supply and control system on the tractor 105. The cylinder 145 includes a downwardly projecting piston rod 152 which is threadably connected to a cylindrical stake pressing member or ram 155 located within an elongated reinforced stake guide member or double wall guide tube 158 supported within the outer tube 132 for vertical sliding movement. The guide tube 158 has an annular upper end wall 162 which slidably receives and surrounds the piston rod 152 and which normally seats on a resilient annular pad or washer 164 mounted on the piston rod 152 adjacent the top end of the ram 155. As shown in FIGS. 10–12, the outer support tube 132 has a vertically extending opening or slot 167 which mates with a partial slot 169 within the mounting tube 138, and the double walt inner guide tube 158 also has a vertically extending opening or slot 172 which aligns with the slots 167 and 169 when the guide tube 158 is retracted to its upper position (FIGS. 11 & 12).

Figure 6:
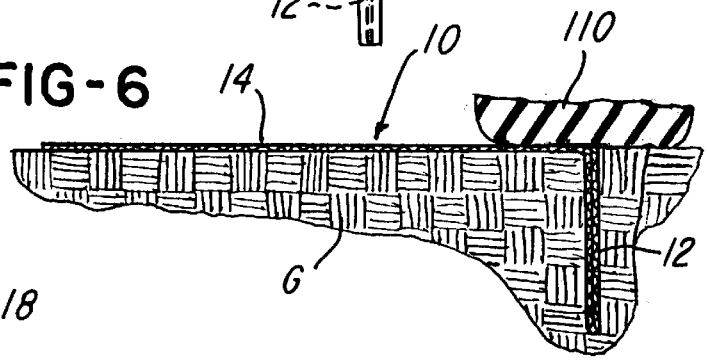
FIG. 6 is a fragmentary section through the ground after a folded edge portion of the silt fence fabric has been inserted, taken generally on the line 6—6 of FIG. 2.
Figure 14:
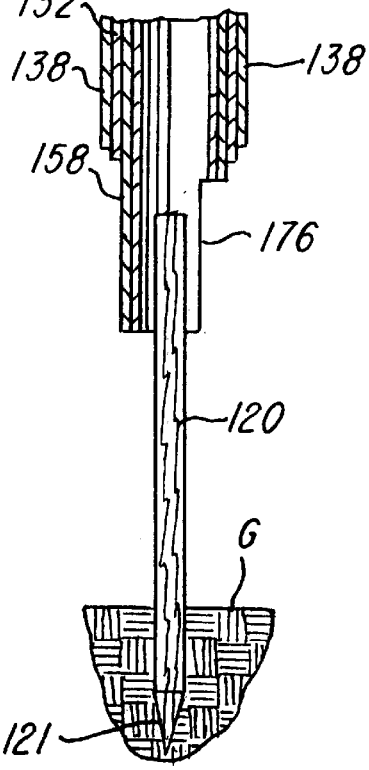

After the earth or ground G is compacted around the folded lower portion 12 of the silt fence 10 by driving the tractor wheels 108 & 110 on one side of the tractor over the ground, as shown in FIG. 6, the wooden stakes 120 are successively driven or pressed into the ground adjacent the folded edge 12 by the apparatus 130. To install the stakes, the operator of the tractor 105 maneuvers the tractor along the upper portion 14 of the silt fence 10, as shown in FIG. 9. When it is desired to insert a stake, the operator stops the tractor and inserts a stake 120 through the aligned slots 167 and 172 and into the guide tube 158 (FIGS. 10 & 11 ) so that the stake drops downwardly until the pointed end portion 121 engages the ground, as shown in FIG. 12. The hydraulic cylinder 145 is then actuated to lower the ram 155 which carries with it the guide tube 158. When the bottom end of the guide tube 158 engages the ground (FIG. 13), the guide tube stops. Continued downward movement of the ram 155 engages the stake 120 and presses the stake into the ground until the lower portion of the stake is inserted into the ground at the desired depth, as shown in FIG. 14.

The hydraulic cylinder 145 is then actuated to retract the ram 155 upwardly. As the ram 155 moves upwardly, it picks up the top end wall 162 of the guide tube 158 and raises the guide tube 158 until both the ram 155 and the guide tube 158 are fully retracted, as shown in FIGS. 11 & 14. The operator of the tractor then moves the tractor forwardly by a predetermined distance, for example, 10 feet, and the operation is repeated for inserting the next successive stake into the ground. As shown in FIG. 14, a lateral opening or rearwardly facing slot 176 is formed within the lower end portion of the guide tube 158 to enable the stake driving apparatus 130 to move forwardly with the tractor while an upper portion of the stake is still located within the guide tube 158. The lateral slot or opening 176 reduces the vertical movement of the guide tube 158 and the piston rod 152 and thus provides for using a double-acting hydraulic cylinder 145 having a shorter length.

From the drawings and the above description, it is apparent that a silt fence installation machine or apparatus constructed in accordance with the present invention provides desirable features and advantages. As one feature, the apparatus for installing the silt fence is simple in construction without any moving parts and is dependable in operation so that the lower folded edge portion 12 has a substantially uniform width and is inserted by the fin 75 directly into the slot 13 formed within the ground by the slightly thicker plow blade 50. The plow blade 50 may also be conveniently removed and replaced in the event the plow blade is damaged, simply by removing the bolts 53, and the fabric folding fin 75 may also be conveniently removed and replaced by removing the bolts 73 if it becomes damaged.

Figures 3, 4:
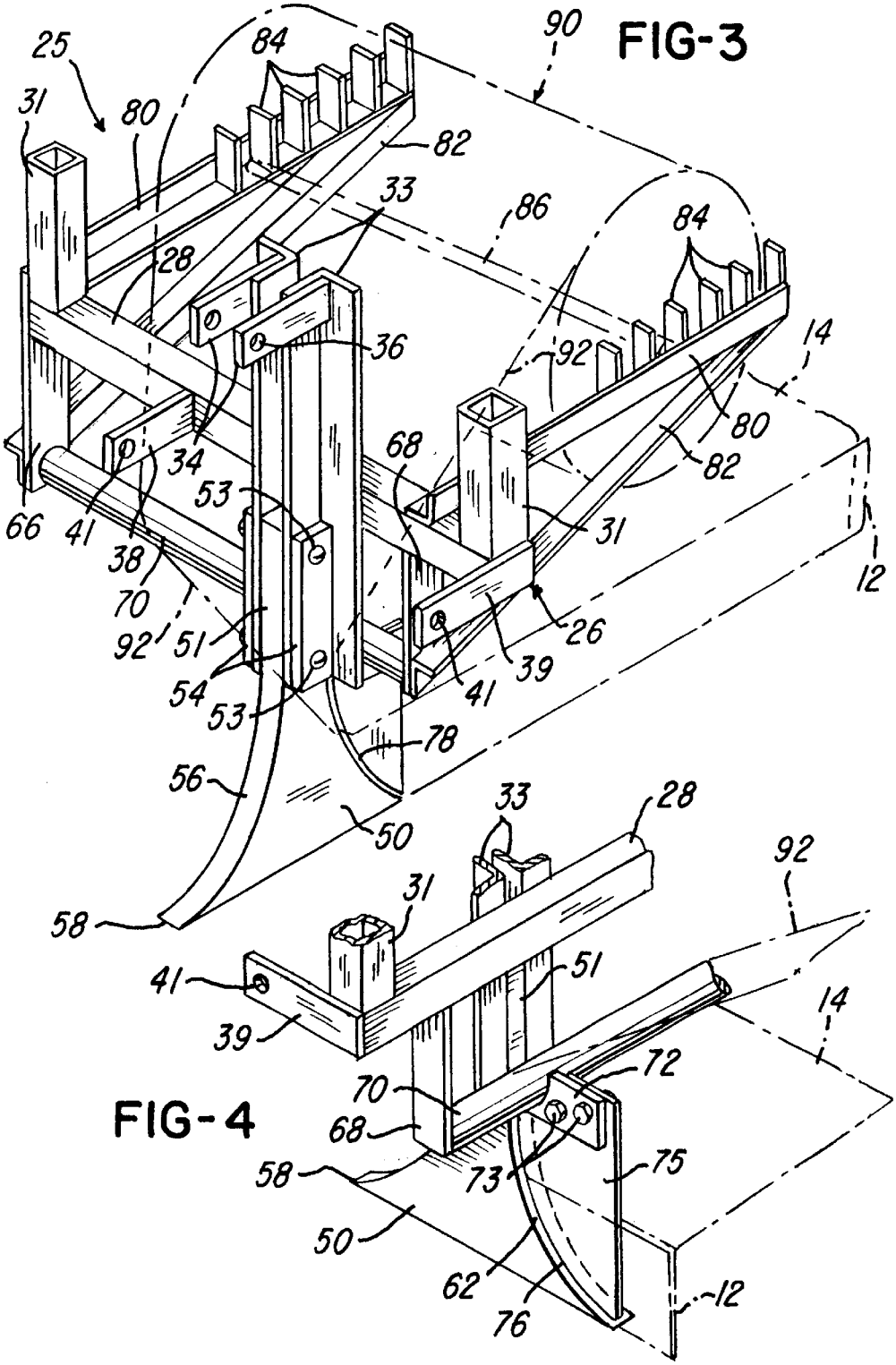
FIG. 3 is a larger perspective view of the apparatus with a portion removed and with the silt fence and its supply roll shown in phantom.
FIG. 4 is an enlarged fragmentary perspective view of a portion of the apparatus shown in FIG. 3.
Figure 5:
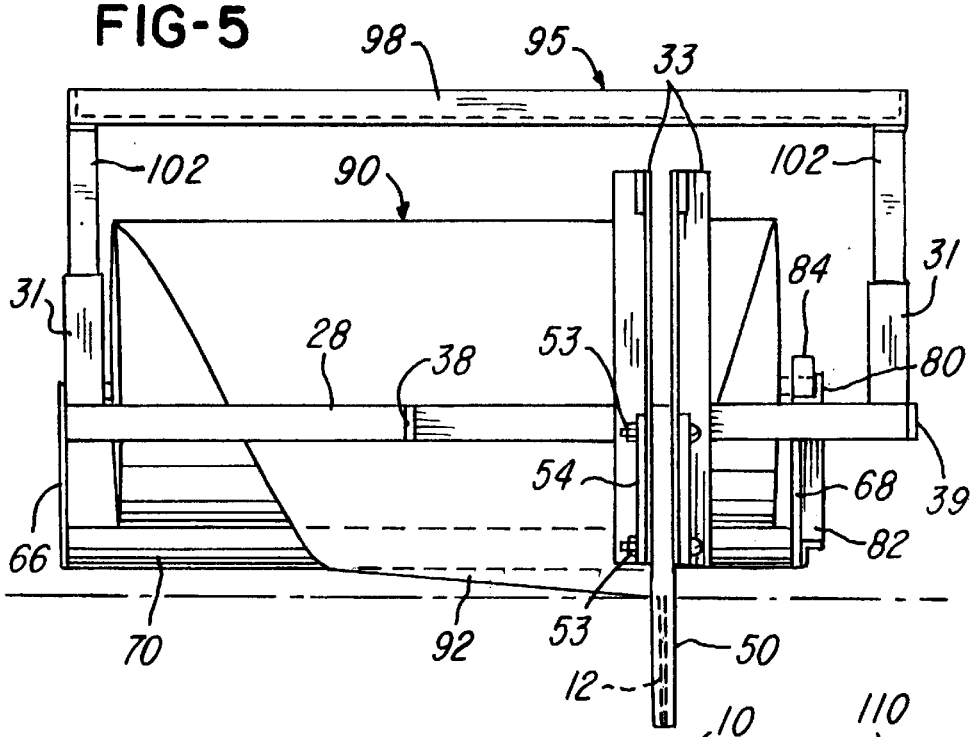
FIG. 5 is a front elevational view of the apparatus, taken generally on the line 5—5 of FIG. 2.

The tabs or plates 84 on the roll support arms or rails 80 also permit the apparatus to handle rolls 90 of different sizes or diameters, and the roll 90 may be shifted forwardly as the roll becomes smaller so that the fabric web 92 engages the guide bar 70 at substantially the same angle regardless of the size of the roll. This provides for producing a folded edge portion 12 having a substantially uniform width as the edge portion 12 is inserted into the slot 13 within the ground by the fin 75. With some rolls of silt fence, it is also desirable to position the support rod or axle 86 at a slight angle or skewed relative to the cross tube 28, as shown in FIG. 3, to assure that the folded edge portion 12 has a uniform width within the ground.

Another feature is provided by the the steel rebar stakes 16 and the cap members 18 since the rebar stakes are more easily inserted into the ground and do not break or decay, as do conventional 2"×2" wood stakes. It is also within the scope of the invention to form each of the cap members 18 with an injection molded plastic body which clips or sockets onto a stake 16 and also clips onto the upper portion 14 of the fabric silt fence 10. The apparatus of the invention may also be mounted on other vehicles, for example, on the lower portion of a bulldozer blade directly in front of an endless track which compacts the soil after the apparatus inserts the lower folded edge portion of the silt fence. The hydraulically actuated pivotal arms on the back of the bulldozer may then be used for pressing the wood or rebar stakes into the ground.

As another feature, the hydraulic stake driving apparatus 130 and its location on the tractor 105 also provide for efficiently installing stakes such as the wood stakes 120. That is, stakes may be conveniently and quickly inserted into the apparatus 130 by the tractor operator, and the stake guide member or tube 158 assures that the stake remains substantially vertical while the stake is pressed into the ground. The position of the apparatus 130 on the tractor adjacent the side of the frame 106 and inboard of the corresponding wheels 108 and 110 on one side of the tractor further provides for using a substantial portion of the weight of the tractor to resist the pressing of the stake 120 into the ground by the hydraulic cylinder 145. Thus more downward force may be applied by the hydraulic cylinder 145. In addition, the tray or platform 114 provide the tractor operator with convenient access to a large supply of stakes 120 without getting off the tractor.

While the forms of apparatus herein described and the methods of installing a silt fence and stakes constitute preferred embodiments of the invention, it is to be understood that the invention is not limited to these precise forms of apparatus and method, and that changes may be made therein without departing from the scope and spirit of the invention as defined in the appended claims.

What is claimed is:

1. Apparatus adapted to be mounted on a tractor for inserting a series of stakes into the ground at horizontally spaced intervals, said apparatus comprising a generally vertical elongated support tube, a stake guide member enclosed by and supported by said support tube for generally vertical movement, an elongated hydraulic cylinder enclosed by and supported by said support tube and having a downwardly projecting piston rod, a stake pressing member connected to said piston rod and supported for generally vertical movement within said stake guide member, said stake guide member having an opening for inserting a stake into said stake guide member under said stake pressing member, and said stake guide member moves generally vertically within said support tube in response to vertical movement of said stake pressing member.

2. Apparatus as defined in claim 1 wherein said stake guide member has a bottom end adapted to engage and be supported by the ground while said pressing member continues downward movement within said stake guide member to press the stake into the ground.

3. Apparatus adapted to be mounted on a tractor for inserting a series of stakes into the ground at horizontally spaced intervals, said apparatus comprising a generally vertical elongated support member, a stake guide tube supported by said support member for generally vertical movement, an elongated hydraulic cylinder supported by said support member and having a downwardly projecting piston rod, a stake pressing member connected to said piston rod and supported for generally vertical movement within said stake guide tube, said stake guide tube having an opening for inserting a stake into said stake guide tube under said stake pressing member, and said stake guide tube having a lower end portion with a lateral opening to permit said guide tube to move forwardly with the tractor while an upper portion of the stake remains within said guide tube.

4. Apparatus in combination with a tractor having a frame supported by a pair of front wheels and a pair of rear wheels, for inserting a series of stakes into the ground at horizontally spaced intervals, said apparatus comprising a generally vertical elongated support member, a stake guide member supported by said support member for generally vertical movement, an elongated hydraulic cylinder supported by said support member and having a downwardly projecting piston rod, a stake pressing member connected to said piston rod and supported for generally vertical movement within said stake guide member, said stake guide member having an opening for inserting a stake into said stake guide member under said stake pressing member, and a mounting bracket connecting said support member to said frame of said tractor between corresponding said front and rear wheels on one side of said tractor and laterally inwardly of said corresponding wheels.

5. Apparatus as defined in claim 4 and including a platform mounted on said tractor and extending forwardly of said apparatus for supporting a supply of stakes.

6. Apparatus adapted to be mounted on a tractor for inserting a series of stakes into the ground at horizontally spaced intervals, said apparatus comprising an elongated generally vertical support tube, a stake guide tube supported by said support tube for movement within said support tube, an elongated hydraulic cylinder supported within said support tube and having a downwardly projecting piston rod extending into said stake guide tube, a stake pressing ram connected to said piston rod within said stake guide tube for generally vertical movement within said guide tube, and said support tube and said stake guide tube have laterally extending openings for inserting a stake into said stake guide tube under said stake pressing ram.

7. Apparatus as defined in claim 6 wherein said stake guide tube moves generally vertically within said support tube in response to vertical movement of said stake pressing ram.

8. Apparatus as defined in claim 6 wherein said stake guide tube has a bottom end adapted to engage and be supported by the ground while said stake pressing ram continues to move downwardly within said stake guide tube to press the stake into the ground.

9. Apparatus as defined in claim 6 wherein said stake guide has a lower end portion with a lateral opening to permit said guide tube to move forwardly with the tractor while an upper portion of the stake remains within said guide tube.

10. Apparatus as defined in claim 6 in combination with a tractor having a frame supported by a pair of front wheels and a pair of rear wheels, and a mounting bracket connecting said support tube to said frame of said tractor between corresponding said front and rear wheels on one side of said tractor and laterally inwardly of said corresponding wheels.

11. Apparatus as defined in claim 10 and including a platform mounted on said tractor and extending forwardly of said apparatus for supporting a supply of stakes.

12. Apparatus mounted on a tractor having a frame supported by a pair of front wheels and a pair of rear wheels for inserting a series of stakes into the ground at horizontally spaced intervals, said apparatus comprising a generally vertical elongated support member, a stake guide member supported by said support member, an elongated hydraulic cylinder supported by said support member and having a downwardly projecting piston rod, a stake pressing member connected to said piston rod for generally vertical movement within said stake guide member, and a mounting bracket secured to said support member and connecting said apparatus to said tractor between said front and rear wheels on one side of said tractor and laterally inwardly of said wheels.

13. Apparatus as defined in claim 12 and including a platform mounted on said tractor and extending forwardly of said apparatus for supporting a supply of stakes.

14. Apparatus as defined in claim 12 in combination with a device for inserting a longitudinal edge portion of a flexible silt fence material into the ground, said device comprising a frame supported by said tractor for movement along the ground, a support on said frame for supporting a supply roll of silt fence material having a predetermined width, a generally vertical plow blade mounted on said frame and having a forwardly facing front surface for cutting a slot within the ground in response to forward movement of said tractor, a generally horizontal material guide bar supported by said frame, a generally vertical material guide member supported by said frame rearwardly of said plow blade for receiving an intermediate portion of the silt fence material directed around said material guide bar, and said guide member being spaced between opposite end portions of said guide bar for progressively folding the intermediate portion of the silt fence material and for guiding a folded edge portion of the material into the slot formed within the ground by said plow blade.

15. Apparatus as defined in claim 14 wherein said plow blade is substantially flat and has a generally uniform thickness, and said guide member comprises a substantially flat guide fin having a generally uniform thickness smaller than said thickness of said plow blade.

16. Apparatus as defined in claim 14 wherein said opposite end portions of said material guide bar are attached to said frame, and said material guide member is supported by an intermediate portion of said guide bar.

17. Apparatus as defined in claim 14 wherein said frame includes a three point hitch connecting said frame to vertically moveable arms on said tractor.

* * * * *